US007448336B2

(12) United States Patent
Wacker et al.

(10) Patent No.: US 7,448,336 B2
(45) Date of Patent: Nov. 11, 2008

(54) DRIVING ARRANGEMENT FOR THE DRIVE ELEMENTS FOR THREADING THE UPPER THREAD INTO THE EYE OF THE NEEDLE OF A SEWING MACHINE

(75) Inventors: Niklaus Wacker, Steckborn (CH); Livio Selm, Berg (CH)

(73) Assignee: Fritz Gegauf AG, Steckborn (CH)

( * ) Notice: Subject to any disclaimer, the term of this patent is extended or adjusted under 35 U.S.C. 154(b) by 0 days.

(21) Appl. No.: 11/679,970

(22) Filed: Feb. 28, 2007

(65) Prior Publication Data

US 2007/0204776 A1 Sep. 6, 2007

(30) Foreign Application Priority Data

Mar. 3, 2006 (CH) ..... 00354/06

(51) Int. Cl.
*D05B 87/02* (2006.01)
*D05B 55/14* (2006.01)

(52) U.S. Cl. ..... 112/225

(58) Field of Classification Search ..... 112/220, 112/221, 225, 235, 237–239, 254, 255
See application file for complete search history.

(56) References Cited

U.S. PATENT DOCUMENTS 5,003,899 A * 4/1991 Ogawa ..... 112/221
5,003,900 A * 4/1991 Ogawa ..... 112/242
5,086,719 A * 2/1992 Ogawa ..... 112/225
5,092,257 A * 3/1992 Ogawa ..... 112/225
5,507,239 A * 4/1996 Fujii et al. ..... 112/274
5,596,941 A * 1/1997 Landen ..... 112/239
7,121,217 B2 * 10/2006 Mizuno et al. ..... 112/225
7,337,734 B2 * 3/2008 Park et al. ..... 112/225

* cited by examiner

*Primary Examiner*—Ismael Izaguirre
(74) *Attorney, Agent, or Firm*—Volpe and Koenig, P.C.

(57) ABSTRACT

A drive arrangement for the drive elements for the threading of the upper thread into the eye of a sewing machine needle is provided. Instead of individual drives for lowering the threading device and rotating it as well as threading the thread regulator to deflect the upper thread around the thread brake, drives not used at that time for the needle rod, the presser foot pressure, and the thread brake are utilized. In this way, two to three additional electric drives can be omitted and thus the controlling expense can be reduced.

7 Claims, 3 Drawing Sheets

DRIVING ARRANGEMENT FOR THE DRIVE ELEMENTS FOR THREADING THE UPPER THREAD INTO THE EYE OF THE NEEDLE OF A SEWING MACHINE

CROSS-REFERENCE TO RELATED APPLICATIONS

This application claims priority from Swiss Application no. 00354/06, filed Mar. 3, 2006, which is incorporated herein by reference as if fully set forth.

BACKGROUND

The invention relates to a drive arrangement for the drive elements for threading the upper thread into the eye of the needle of a sewing machine.

Drive arrangements for threading devices of this type are known in many embodiments. They serve to relieve the operator of the sewing machine from the tedious threading of the upper thread into the eye of the needle. Simple threading aids are operated manually, i.e. the upper thread is inserted into a suitable tool and this facilitates the treading process. In automatic threading devices first the thread must be placed in front of the device before the latter then performs the threading process via separate drives in the sewing machine.

The most frequently used automatic threading devices pivot the threader around a horizontal axis downwards from a resting position in the upper arm towards the needle. Further, motorized threading devices are also known in which, similar to the manually operated ones, the threading device is guided vertically downwards along an actuator rod parallel to the needle rod and is pivoted out of this position around said actuator rod. These known threading devices require a suitable electric drive for the lowering process, e.g., a stepper motor, which guides the threading device via a toothed rod downwards and, after the threading, back upwards. Here, the pivoting motion inevitably occurs in a curved path, along which the device at the end of the lowering motion is additionally rotated around the actuator rod.

Both the threading devices with motion around the horizontal axis in the upper arm of the sewing machine as well as those that are vertically displaced by an electric motor need comparatively much space. This leads to a voluminous upper arm housing, which limits the direct visual contact of the operator to the sewing area.

SUMMARY

One object of the present invention comprises providing a drive arrangement for the drive elements for a threader, which requires little space and which, in the resting position, also can essentially be retracted entirely into the upper arm and thus prevents any hindrance to handling during the sewing operation.

This object is attained by a drive arrangement for the drive elements for a threader having the features of the present invention, in which the threader is embodied such that it can be connected to the needle rod actuator that is decoupled from the needle rod. Advantageous embodiments of the device are described below.

By omitting a separate, individual drive, the invention achieves maintaining a small space that is necessary for the processing motions of the threading device, so that there is sufficient room inside a narrow housing. Further, supervision devices are omitted, which control and/or synchronize the respective position of the needle rod and thus the eye of the needle and the threading device. All motions necessary for threading occur automatically synchronized. By omitting one or more additional drive motors for the threading device and alternatively also for the controllable threading motor, the necessary controls and/or the already mentioned synchronization of the individual drives connected thereto is also omitted.

BRIEF DESCRIPTION OF THE DRAWINGS

The invention is described in the following using an illustrated exemplary embodiment. Shown are.

DETAILED DESCRIPTION OF THE PREFERRED EMBODIMENTS

Figure 1:
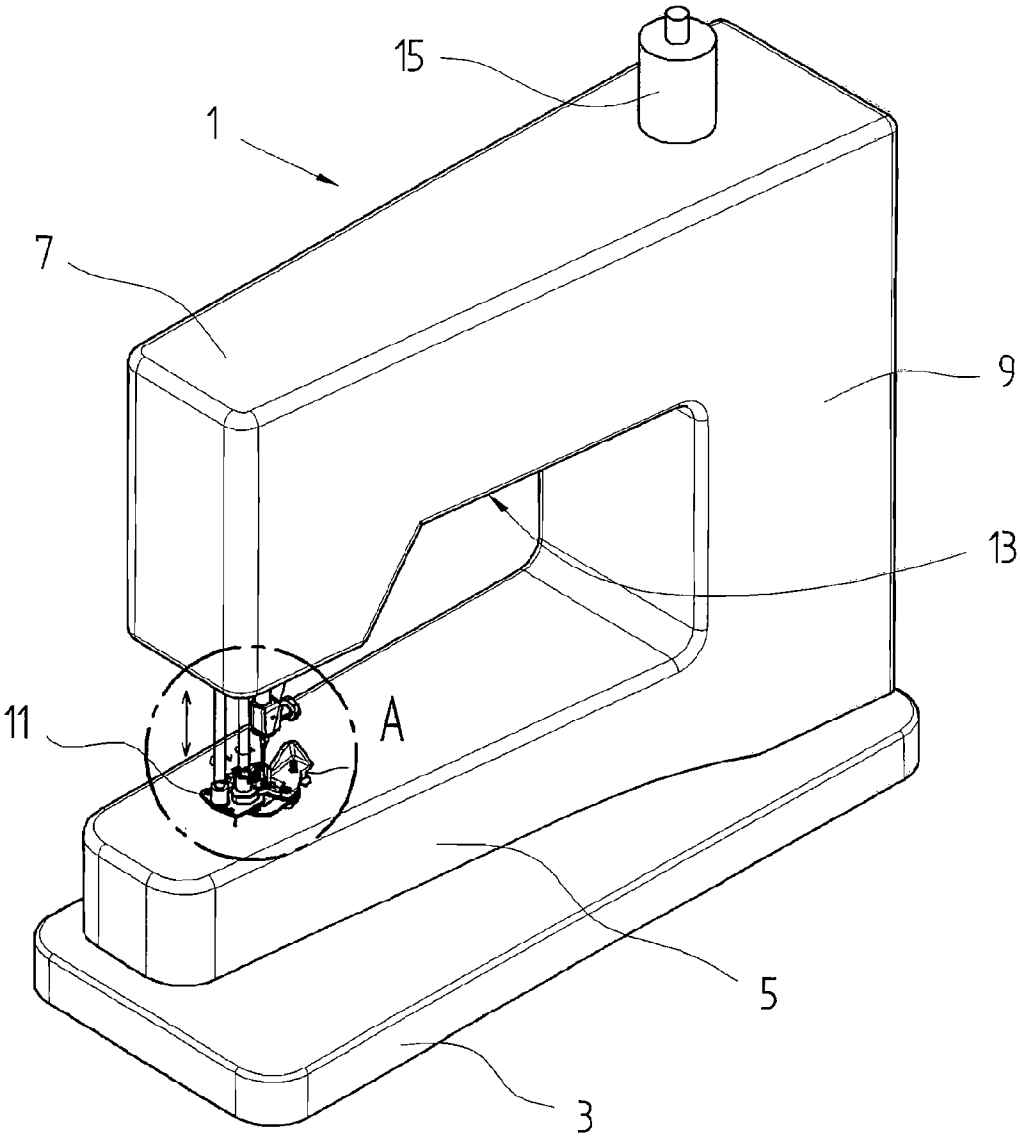
FIG. 1 is a schematic perspective representation of a sewing machine with a lowered threader.
Figure 1:
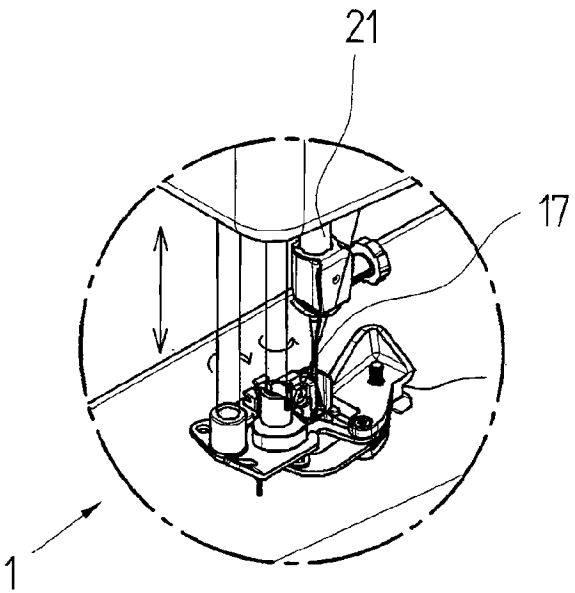

FIG. 1 shows in a schematic representation a household sewing machine 1 with a base plate 3, a free arm 5, as well as an upper arm 7. The free arm as well as the upper arm are connected to each other by the machine housing 9 A threading device 11 is arranged in the front end of the upper arm 7, which can be deployed from the bottom 13 of the upper arm 7. In FIG. 1 the threading device 11 is entirely deployed, i.e. lowered. On the upper side of the upper arm 7 schematically a spool holder for the upper thread is shown having an upper thread spool 15. Further, reference character 17 indicates a needle, having an eye of the needle 19 at its lower end. The needle 17 is connected to the bottom end of a needle rod 21. A presser foot rod 23 is shown behind the needle rod 21, with the presser foot 25 being mounted to its lower end.

Figure 2:
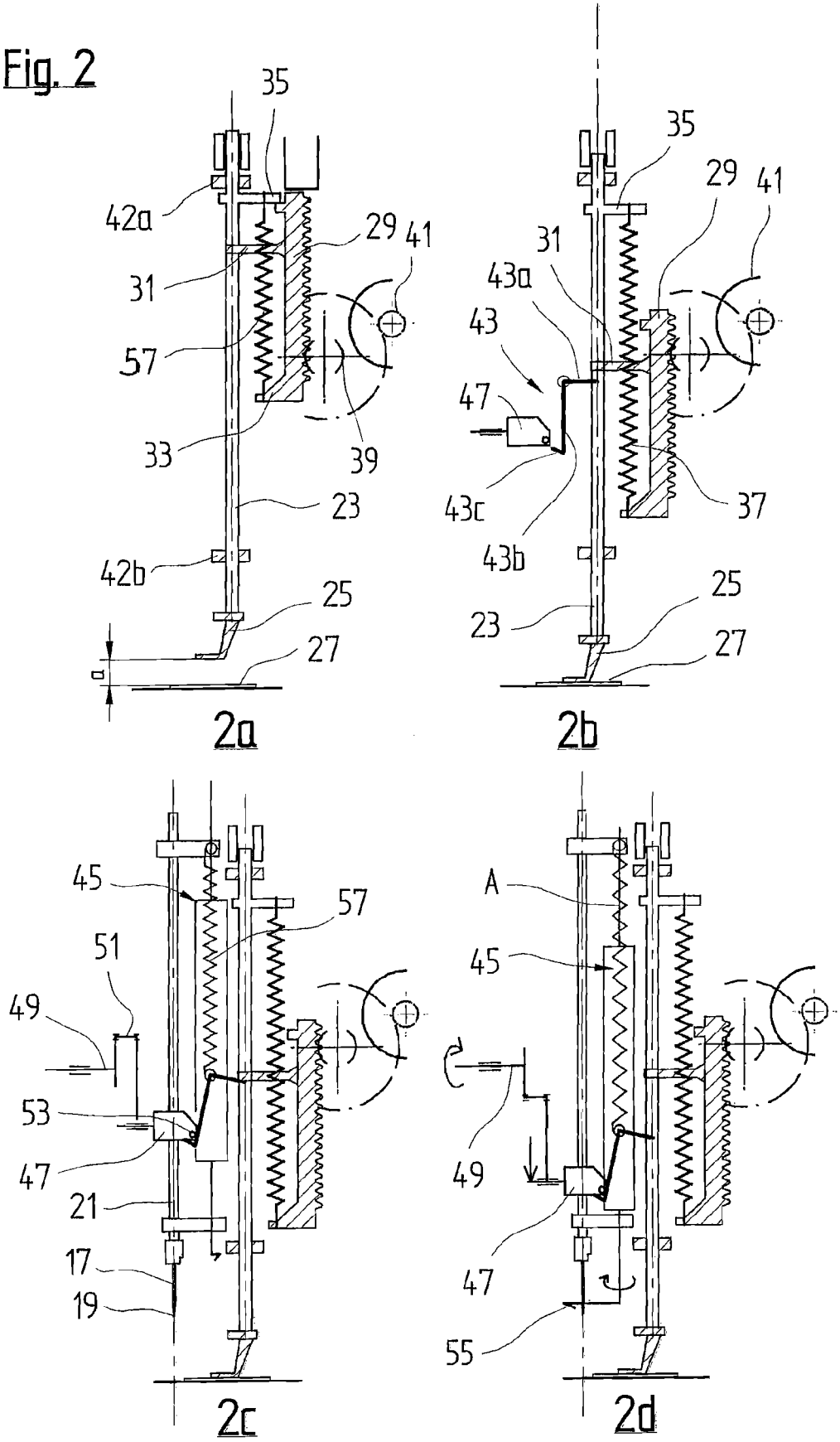
FIGS. 2*a-d* are views showing four separate positions of the threader.

The elements, briefly described above, are illustrated schematically in more detail in FIGS. 2*a* through 2*d*, separated from the sewing machine. In FIG. 2*a*, the presser foot rod 23 with the presser foot 25 is lifted off the stitching plate 27 on the lower arm 5 by a distance $\alpha$. The raising of the presser foot 25 occurs in a manner known per se by a lifter lever (or can be motorized), which is not shown therefore to improve visibility. A toothed rod 29 with an actuator 31 is mounted and guided longitudinally parallel to the presser foot rod 23. A spring 37 is clamped between the lower end 33 of the toothed rod and a bracket 35 mounted to the presser foot rod 23 in a fixed manner. The spring is only slightly stressed when the presser foot 25 is raised. The toothed rod 29 is engaged with a sprocket 39, which can be driven by an electric motor, e.g., a stepper motor 41. The reference characters 42*a* and 42*b* indicate longitudinal guides for the presser foot rod 23.

In FIG. 2*b* the presser foot rod 23 with the presser foot 25 is lowered to the stitching plate 27 via the lifting lever (not shown) or in a motorized manner. Simultaneously the toothed rod 29 has been lowered by the stepper motor 41 and thus the spring 37 has been stressed further. The tensile force of the spring 37 serves to press the presser foot rod 23 with the presser foot 25 toward the stitching plate 27 using the bracket 35. Thus the pressure of the presser foot 25 to the stitching plate and/or the sewing material (not shown) positioned between the presser foot 25 and the stitching plate 27 can be adjusted by the stepper motor 41.

The two functions shown in FIGS. 2*a* and 2*b* are known from prior art and are used in higher priced sewing machines.

In FIG. 2*b* it is further discernible that the actuator 31, which is not included in conventional sewing machines, is positioned at a short distance above the two-armed lever 43. The two-armed lever 43 is linked to a threader 45 in a mobile fashion. The first leg 43*a* of the lever 43 extends below the actuator 31 at a distance; the second leg 43*b* of the lever 43 carries a hook 43*c* on a free end thereof. The hook is located outside the vertical displacement area of the needle rod actuator 47 in the position of the toothed rod 29 shown in FIG. 2*b*. The actuator is connected to the driving device, needle drive 49 for short. The needle drive 49 with the needle rod actuator 47 is known from prior art and comprises, as shown in FIGS. 2*c* and 2*d*, a crank drive 51. The actuator 47 is decoupled from the needle rod 21 in the positions shown in FIGS. 2*b* through 2*d*. When now the toothed rod 29 is further lowered by the stepper motor 41 out of the position shown in FIG. 2*b* into the position shown in FIG. 2*c* the actuator 31 pivots the leg 43*a* of the lever 43 clock-wise such that the hook-shaped end 43*c* reaches a position below the needle rod actuator 47 (FIG. 2*c*). Preferably, a suitable bolt 53 is arranged at the needle rod actuator 47. Now, the threader 45 can be lowered (FIG. 2*d*) by the needle rod actuator 47 via the needle drive 49.

During the lowering of the threader 45, a threading hook 55 is inevitably pivoted around the axis A of the threader 45 in a curve not shown and the threading process can be performed. The threading process is not described in greater detail, because it can occur in differently operating devices regardless of the processing steps described in FIGS. 2*a* through 2*d*.

After the threading process the needle drive 49 guides the needle rod actuator 47 upwards, which simultaneously causes the threader 45 to be returned into the resting position by the tensile force of a second spring 57 stressed during the lowering of the threader 45.

Similar to the exemplary embodiment in FIGS. 1 and 2*a*-2*d*, for the motion drive of the threader 11 with the already existing drives for the needle rod 21 and the presser foot pressure the transfer of the upper thread can also lead to a deflection, which increases the wrapping angle of the thread brake 61, and thus leads to the insertion of the thread regulator (not shown) having an existing drive, namely the drive motor 59 for the thread brake 61. In FIGS. 3*a* through 3*d*, in four steps, it is shown schematically how, on the one side, the structure of the braking force occurs in the thread brake 61 with the drive motor 59 of the thread brake 61 and how a thread deflection lever 73 can be operated by the same motor.

Figure 3:
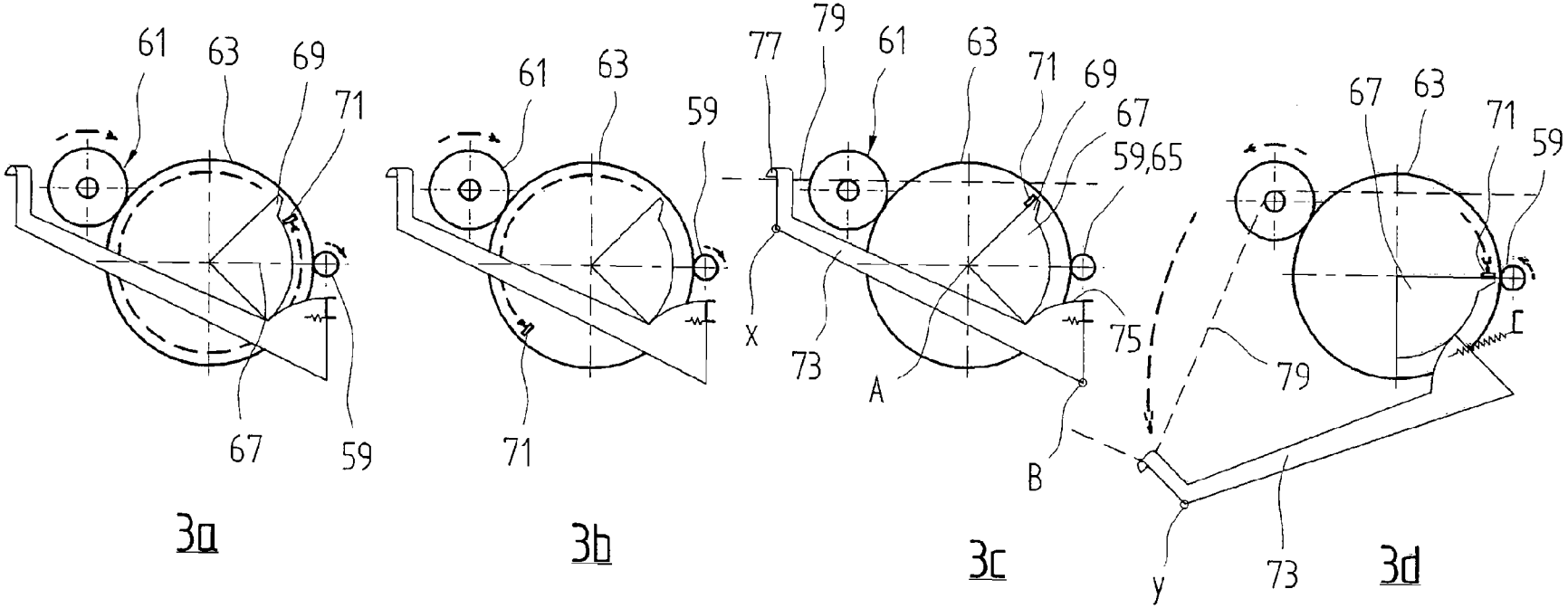
FIGS. 3*a-d* are schematic representation of the operating processes of the drive of the threading device.

In the illustrations in FIGS. 3*a*-3*d*, the thread brake 61 is shown, which comprises two discs that can be elastically pressed against each other (not shown in detail). The two discs are located axially behind the thread brake 61, shown schematically as a circular plate. An actuator disc 63, its periphery being embodied as a sprocket, which is engaged by a driving sprocket 65 of the drive motor 59, is arranged between the drive motor 59 and the thread brake 61. At the face of the actuator disc 63, a toothed segment 67 is arranged pivotal around the rotary axis A of the actuator disc 63, which includes a protrusion 69 on one side. The protrusion 69 contacts the cam 71 in the resting position (FIG. 3*c*). A thread displacement lever 73 is pivotally arranged on a pivot axis B located outside the periphery of the actuator disc 63. In the area of the deflection of the thread deflection lever 73, the lever is provided with a toothed segment 75, which engages the teeth of the toothed segment 67 on the actuator disc 63. An actuator hook 77 is formed at the free end of the thread displacement lever 73.

FIG. 3*c* shows, as already mentioned, the resting position of the actuator disc 63, in which the first toothed element 67 contacts the cam 71 and in which the thread brake 61 and the two discs forming the thread brake 61 are at a distance (from each other) so that the upper thread can be inserted thereto. In a known fashion, after the threading of the thread by the drive motor 59, the thread brake 61 and/or a spindle are driven, thus the two discs of the thread brake 61 approach one another. Here, the cam 71 moves on the actuator disc 63 counter-clock wise by approx. 180° (FIG. 3*b*). When the thread tension must be increased even more, the drive motor 59 further rotates the actuator disc 63 in the counter-clockwise direction until the cam 71 approaches the protrusion 69 on the first toothed segment 67 from the other side (cf. FIG. 3*a*).

At the beginning of the threading process for the upper thread the thread brake 61 is in the resting position according to FIG. 3*c*. In order to achieve an optimum deflection of the upper thread into the thread brake 61 and/or to insert the thread into the thread regulator, the upper thread 79, initially extending in a straight manner, must be deflected towards the thread brake 61. This occurs via the thread deflection lever 73, with its actuator hook 77 grasping the upper thread and transferring it from the initial position X into the deflection position Y. In order to transfer the thread deflection lever 73 from position X into position Y the rotational direction of the drive motor 59 is reversed so that the actuator disc 63 rotates in the clockwise direction. Here, the cam 71 also rotates the first toothed segment 67 in the clockwise direction and thereby pivots the thread deflection lever 73 engaging the toothed segment 67 into the position Y (FIG. 3*d*).

As soon as the thread deflection lever 73 reaches position Y, the upper thread leaps over a deflection protrusion, not shown, and is guided there such that the thread deflection lever 73 is returned into the resting position by rotating the drive motor 59 in the opposite rotational direction and, when the motor 59 continues to rotate in the same rotational direction the thread brake 61, according to FIGS. 3*b* and/or 3*a*, can be stressed. The drive motor 59 of the thread brake 61 therefore performs two entirely different tasks: at the beginning of the threading process the thread deflection lever 73 pivots out of the resting and catching position into the transfer position Y and subsequently it serves to regulate the thread brake 61.

List of Reference Characters

1 sewing machine
3 base plate
5 free arm
7 upper arm
9 machine housing
11 threading device
13 bottom of
15 upper thread spool
17 needle
19 eye of the needle
21 needle rod
23 presser foot rod
25 presser foot
27 stitching plate
29 toothed rod
31 actuator
33 bottom end of 29
35 bracket
37 spring
39 sprocket
41 stepper motor
42 longitudinal guidance
43 two-armed lever
45 threader
47 needle rod actuator
49 needle drive
51 crank drive

53 bolt
55 threading hook
57 spring
59 drive motor for thread brake
61 thread brake
63 actuator disc
65 sprocket for downward drive
67 toothed segment
69 protrusion
71 cam
73 thread deflection lever
75 toothed segment
77 actuator hook
79 upper thread

The invention claimed is:

1. A drive arrangement for drive elements for threading an upper thread into an eye (19) of a needle (17) of a sewing machine (1), comprising a needle rod (21) carrying the needle (17), a needle rod actuator (47), which can be coupled to and decoupled from the needle rod (21), a presser foot (25) on a presser foot rod (23), the presser foot (25) is movable from a resting into an operating position via a lifter lever and has an additional pressure device driven by an electric motor, a lifting drive for a threader (11) arranged to be vertically displaceable, and a threading hook (55) arranged at a lower end of a threader (31) and pivotable around a vertical axis, the threader (11) is lowerable for the threading process by a connection to the needle rod actuator (47) when the needle rod actuator is decoupled from the needle rod (21).

2. A drive arrangement according to claim 1, wherein for transfer of the threader (11) from a readiness position into a resting position in the upper arm (7) of the sewing machine (1) and for deploying the threader from the resting position into the readiness position, a drive motor (41) of a pressure device for the presser foot (25) creates additional lifting motions of the threader (11).

3. A drive arrangement according to claim 2, wherein a pivotal lever (43), pivoted by the drive device of the presser foot (25), is pivotally linked to the threading device (11) for coupling the needle rod actuator (47) to the threader (11).

4. A drive arrangement according to claim 3, characterized in that the pressure device can move farther downwards in order to couple to the lever (43).

5. A drive arrangement according to claim 3, wherein the lever (43) is embodied so that it can snap to a bolt (53) at the needle rod actuator (47).

6. A drive arrangement according to claim 1, further comprising a thread brake (61) having a drive motor (59) for adjusting the thread tension effectively connected to an actuator disc (63), the actuator disc (63) being connected to a thread brake (61) in a first rotary direction and is connected to a thread deflection lever (73) in a second rotary direction in order to move the thread deflection lever (73) out of a resting position (X) into a deflection position (Y).

7. A drive arrangement according to claim 6, wherein the thread deflection lever (73) can be pivoted by the actuator disc (63) arranged between the drive motor (59) and the thread brake (61) which has a toothed segment (67), which engages the thread deflection lever (73) when the actuator disc (63) is rotated in the second rotary direction.

* * * * *